US005400465A

United States Patent [19]

Bosses et al.

[11] Patent Number: 5,400,465

[45] Date of Patent: Mar. 28, 1995

[54] VACUUM CLEANER WITH CHARGE GENERATOR AND BAG THEREFOR

[75] Inventors: Mark D. Bosses, Montvale; Anthony Albanese, Clifton, both of N.J.

[73] Assignee: Home Care Industries, Inc., Clifton, N.J.

[21] Appl. No.: 219,789

[22] Filed: Mar. 30, 1994

[51] Int. Cl.[6] ..... B03C 3/00; A47L 9/10

[52] U.S. Cl. ..... 15/339; 55/DIG. 2; 96/55; 96/59; 96/66

[58] Field of Search ..... 15/339; 55/DIG. 2, DIG. 3; 96/55, 57, 59, 66

[56] References Cited

U.S. PATENT DOCUMENTS

| | | | |
|---|---|---|---|
| 4,163,650 | 8/1979 | Watson et al. | 15/339 X |
| 4,198,061 | 4/1980 | Dunn . | |
| 4,941,224 | 7/1990 | Saeki et al. . | |
| 4,941,230 | 7/1990 | Lamore . | |
| 4,976,752 | 11/1990 | Török et al. | 96/55 X |
| 5,143,524 | 9/1992 | Inculet et al. . | |
| 5,217,511 | 6/1993 | Plaks et al. | 96/55 |
| 5,230,723 | 7/1993 | Travis et al. | 96/57 |
| 5,306,534 | 4/1994 | Bosses . | |
| 5,330,559 | 7/1994 | Cheney et al. | 96/59 X |

FOREIGN PATENT DOCUMENTS

| | | | |
|---|---|---|---|
| 2717834 | 11/1977 | Germany | 96/55 |
| 39275 | 3/1979 | Japan | 96/55 |

OTHER PUBLICATIONS

IAS'93 Cover and pp. 1749–1753.

*Primary Examiner*—Christopher K. Moore
*Attorney, Agent, or Firm*—Amster, Rothstein & Ebenstein

[57] ABSTRACT

A vacuum cleaner system includes a vacuum cleaner having a hollow air inlet, an air outlet, a removable dirt bag communicating with the inlet and the outlet, and means for moving initially dirt-laden air from the inlet to the outlet via the bag. The system also includes a charge generator for generating an electrostatic charge of a given polarity on the bag. The system optionally includes a charge generator for generating an electrostatic charge of the given polarity on the initially dirt-laden air.

9 Claims, 3 Drawing Sheets

VACUUM CLEANER WITH CHARGE GENERATOR AND BAG THEREFOR

BACKGROUND OF THE INVENTION

The present invention relates to a vacuum cleaner system using an electrostatically charged bag and a bag suitable for use therein.

A conventional vacuum cleaner includes a hollow air inlet, an air outlet, a removable dust bag communicating with the inlet and the outlet, and means for moving initially dirt-laden air from the inlet to the outlet via the bag so that the dirt remains trapped within the bag. Modern dust bags are typically disposable 2-ply dust bags comprised of an inner ply of highly air-permeable material and a conventional outer ply of air-permeable material. The inner or filter ply is actually a non-woven liner formed of randomly intertangled discontinuous microfibers of synthetic material and assists in the trapping of smaller dirt particles within the bag.

It has recently been found to be advantageous to charge the dust bag—and in particular the non-woven liner of a 2-ply dust bag—with an electrostatic charge. As many of the smaller dust particles typically naturally contain a negative charge, the use of a negatively charged bag causes the bag to repel the approach of the negatively charged dust particles and thus maintains the dust particles within the bag. By increasing this type of "magnetic filtration," one does not have to rely as much on the mechanical filtration characteristics (that is, the permeability) of the dust bag because the charge on the dust bag supplements the low permeability of the dust bag in trapping dust particles. This permits the bag to be significantly more porous, and thereby reduces the pressure drop differential resulting from the air passing through the bag. Accordingly, there is a greater air flow through the bag as a result of the same pressure drop. Increased vacuum cleaner cleanability and increased bag fill capacity typically result.

Thus, electrostatically charged dust bags (and especially 2-ply vacuum cleaner dust bags with an electrostatically charged inner ply) are commercially available. Typically, during the manufacture of the inner ply fabric, the fabric is corona treated to create the electrostatic charge thereon. The electrostatically charged fabric is then used in the manufacture of a 2-ply vacuum cleaner dust bag, which is then sold to end users for use in vacuum cleaners. The problem with prior art electrostatically charged dust bags is the fact that the electrostatic charge tends to bleed away rapidly over time. Further, these dust bags are more expensive to manufacture because of the extra step of corona treatment. Thus, a significant portion of the charge is typically lost with a concomitant loss in cleaning power. As a result, manufacturers of electrostatically charged dust bags must still rely primarily on the mechanical filtration characteristics of the bag.

Accordingly, it is an object of the present invention to provide a vacuum cleaner system wherein the leakage of electrostatic charge from the dust bag does not adversely affect operation of the vacuum cleaner.

Another object is to provide such a system which does not require protection of the dust bag from moisture at any time.

A further object is to provide such a system which in one embodiment enables the user of the system to decide whether or not to employ an electrostatically charged dust bag.

It is also an object of the present invention to provide such a system which in one embodiment increases the efficacy of the magnetic filtration characteristics of an electrostatically charged dust bag or imparts magnetic filtration characteristics to an uncharged dust bag.

It is another object to provide dust bags suitable for use in such a system.

SUMMARY OF THE INVENTION

It has now been found that the above and related objects of the present invention are attained in a vacuum cleaner system comprising a vacuum cleaner and first generating means for generating an electrostatic charge of a given polarity in situ on the dust bag. More particularly, the vacuum cleaner includes a hollow air inlet, an air outlet, a removable dust bag communicating with the inlet and the outlet, and means for moving initially dirt-laden air from the inlet to the outlet via the bag.

In a preferred embodiment, the system additionally includes second means for generating an electrostatic charge of the given polarity on the initially dirt-laden air. In the preferred embodiment, the system additionally charges the initially dirt-laden air entering through the inlet into the dust bag with an electrostatic charge of the same polarity so that the small uncharged dust particles, which might otherwise have escaped both the magnetic and mechanical filtration, are now charged and thus more likely to be trapped by the magnetic filtration. The given polarity is preferably negative. The first generating means is an electrostatic generator, and the second generating means is means for producing a corona discharge. Means are provided for manually activating and deactivating each of the generating means.

The dust bag preferably comprises an air-permeable non-woven filter inner ply and an air-permeable outer ply. Each of the first generating means and the bag defines an electrical contact, the electrical contacts being in electrical communication when the bag is disposed in the cleaner for use therein so that the first generating means generates the electrostatic charge in the inner ply of the bag. The electrical contacts of the first generating means and the bag are disposed in the exterior of the inlet and the interior of the bag, respectively.

The first generating means may also generate an electrostatic charge on the initially dirt-laden air passing through the inlet when it is a corona discharge apparatus having its spaced apart electrical contacts disposed on the interior of the inlet. Thus, a single generating means may be capable of generating an electrostatic charge of the given polarity in both the bag and the initially dirt-laden air.

The present invention also encompasses a dust bag for use in a vacuum cleaner including a hollow air inlet defining a first electrical contact, and means for generating at the first electrical contact an electrostatic charge of a given polarity. The bag comprises a semi-permeable enclosure defining an air entrance, and, a collar disposed about the entrance and defining a second electrical contact configured and dimensioned for electrical communication with the first electrical contact when the bag is in use.

In a preferred embodiment, the first electrical contact is disposed on the interior of the inlet for electrical communication with the second electrical contact, the second electrical contact being disposed on the interior of the bag. The given polarity is negative. The bag preferably comprises an air-permeable non-woven filter inner ply and an air-permeable outer ply, and the second electrical contact is in electrical communication with the inner ply.

The present invention may be used either with a non-charged bag to charge the bag or with a charged bag to replenish or increase the charge in situ as the bag is being used.

BRIEF DESCRIPTION OF THE DRAWING

The above and related objects, features and advantages of the present invention will be more fully understood by reference to the following detailed description of the presently preferred, albeit illustrative, embodiments of the present invention when taken in conjunction with the accompanying drawing wherein.

DETAILED DESCRIPTION OF THE PREFERRED EMBODIMENTS

Figure 1:
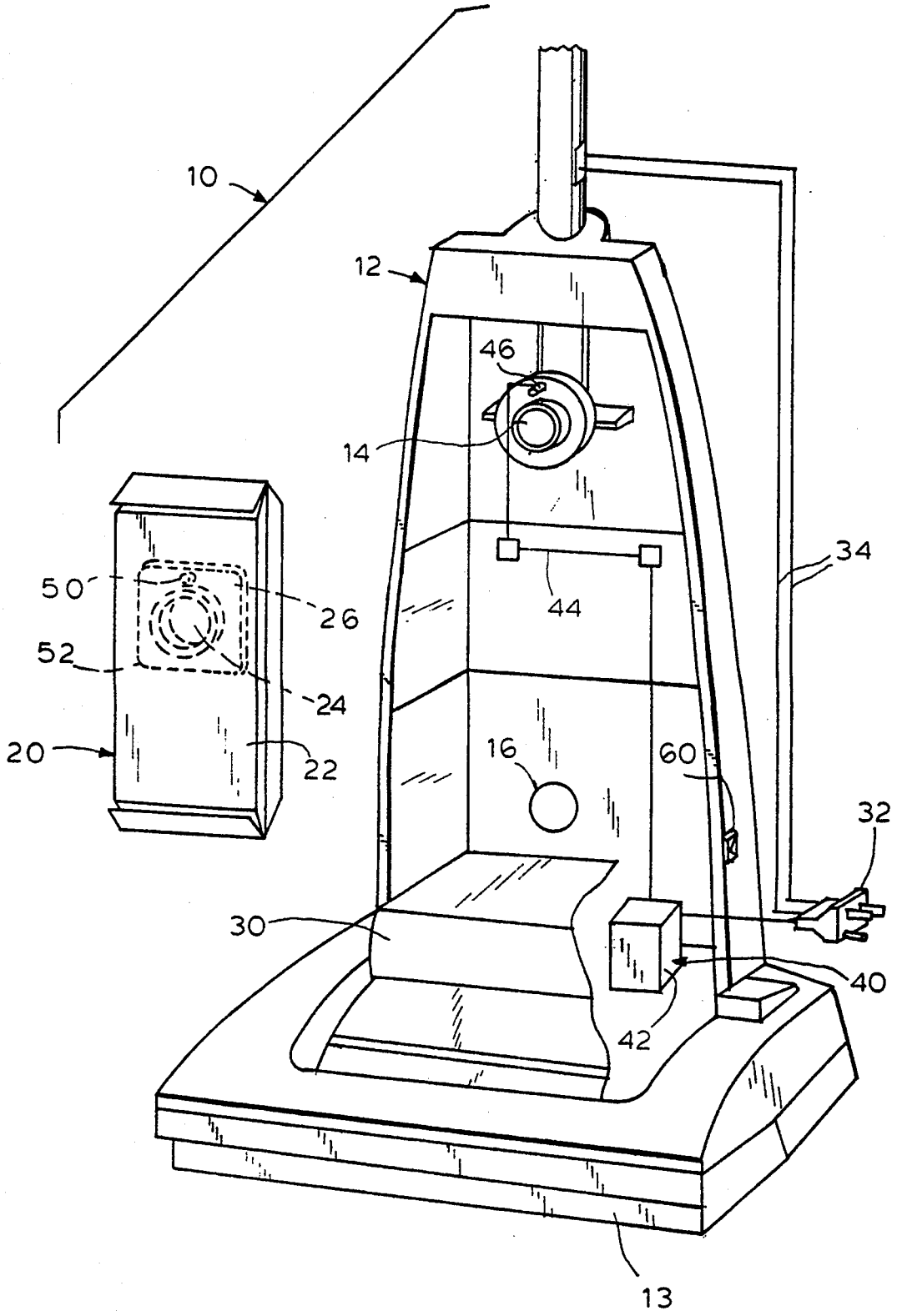
FIG. 1 is a partially exploded isometric view of a vacuum cleaner system according to the present invention.

Referring now to the drawing, and in particular to FIG. 1 thereof, therein illustrated is a vacuum cleaner system according to the present invention, generally designated by the reference numeral 10. The system 10 includes a vacuum cleaner, generally designated 12, which in its conventional aspects, includes a hollow air inlet 14 and an air outlet 16. An air intake 13 disposed at the bottom of the vacuum cleaner 12 communicates with air inlet 14 via an air-tight conduit (not shown). The vacuum cleaner 12 is illustrated with the front of the housing thereof removed so as to reveal details of internal construction.

Figure 2:
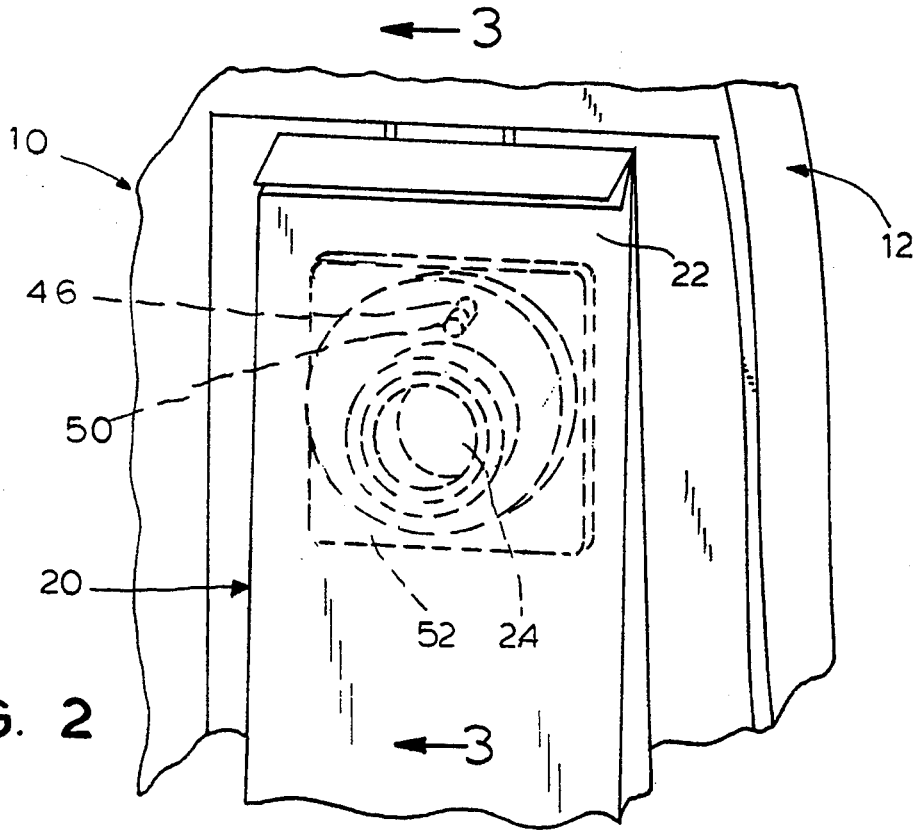
FIG. 2 is a fragmentary isometric assembly view thereof, to a greatly enlarged scale.
Figure 3:
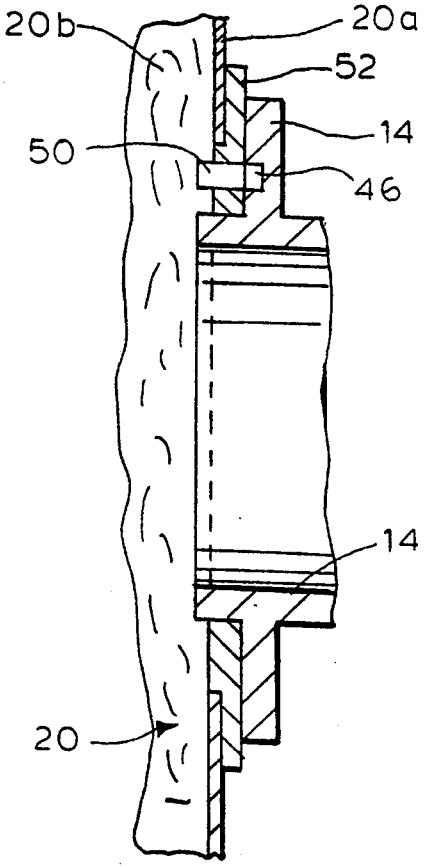
FIG. 3 is a sectional view taken along the line 3—3 of FIG. 2, to an enlarged scale.

A removable dust bag, generally designated 20, is shown separate from the vacuum cleaner 12 in FIG. 1 but, when properly installed on inlet 14 of the vacuum cleaner 12, as illustrated in FIGS. 2 and 3, it communicates gaseously with both the inlet 14 and the outlet 16. Bag 20 is formed of a semi-permeable enclosure 22 defining an air entrance 24, and a generally stiff collar 26 disposed about the entrance 24. The bag 20 is preferably a disposable 2-ply bag comprised of a conventional outer ply of 20*a* of permeable material and an inner ply 20*b* which is a non-woven liner formed of randomly intertangled discontinuous microfibers of synthetic material such as polypropylene or a like melt-blown thermoplastic.

A motor driven blower 30 is provided for moving initially dirt-laden air from the inlet 14 to the outlet 16 via the bag 20, the dirt-laden air entering the bag entrance 24 and the cleaned air departing via the walls of the semi-permeable enclosure 22 through air outlet 16. The motor of the blower 30 typically operates on wall current provided via a grounded plug 32 and wires 34.

As the vacuum cleaner 12 and bag 20 described hereinabove are conventional, it is not deemed necessary to set forth the details thereof herein or to show in FIG. 1 the details of the vacuum cleaner as described hereinabove. It will be appreciated that, while an upright vacuum cleaner has been described and shown, the principles of the present invention apply to all vacuum cleaners including the floor or canister-type.

In its novel aspects, the vacuum cleaner system 10 of the present invention additionally includes first means, generally designated 40, for generating an electrostatic charge of a given polarity on the bag 20 in situ. The charge generating means 40 includes a conventional electrostatic generator 42 such as a Wimshurst generator, Van De Graaff generator, a friction generator, or a solid-state electronic electrostatic generator. The generator must be capable of creating the desired 1,000–15,000 volt electrostatic charge on the bag 20, and preferably on the inner ply of a disposable 2-ply bag 20. Of course, the electrostatic charge needed may exceed 15,000 volts depending upon the size and type of the vacuum cleaner, the air flow rate, etc.

The electrostatic generator 42 is connected by a conductive lead 44 to an electrical contact 46 disposed on or about inlet 14. An electrical contact 50 is electrically connected to bag 20, and preferably the inner ply 20*b* thereof, so that electrical charges will propagate along and throughout the bag 20, and preferably its inner ply 20*b*. Where the bag 20, and particularly the inner ply 20*b* thereof, is not conducive to conducting electrostatic charges, it may be provided with conductive platelets formed of metal foils, Mylar, conductive inks, or the like in order to assist in the propagation of the charge throughout the bag 20, and especially throughout the inner ply 20*b*. As best seen in FIG. 3, the electrical contact 50 passes through the collar 52 and the bag outer ply 20*a* and is in electrical contact with electrical contact 50 of the bag inner ply 20*b*.

To ensure electrical communication between the electrical contacts 46, 50, the collar 52 and inlet 14 may define a key/keyway arrangement to ensure the appropriate angular orientation of the two elements when mounted together. When the bag 20 is properly mounted on the air inlet 14 of the vacuum cleaner 12, as best seen in FIGS. 2 and 3, the electrical contact 46 of the vacuum cleaner 12 and the electrical contact 50 of the bag 20 are in electrical communication. Thus, the electrostatic charges (e.g., electrons) generated by the electrostatic generator 42 are communicated via the conductive lead 44 and electrical contacts 46, 50 to the bag inner ply 20*b*.

Where the bag 20 has been negatively charged at the factory, any loss in that negative charge over time, during use or due to humidity, may be replaced or enhanced; indeed, the negative charge may even be increased over that which was applied at the factory. However, as the charge generating means is capable of rapidly building the necessary charge on the bag 20, it is contemplated that the present invention will be especially useful with bags which have not been electrostatically charged at the factory, thereby saving on bag manufacturing, packaging and handling costs (i.e., avoiding the need for moisture-proof packaging), while insuring that a full charge is on the bag each and every time that it is put in use.

It will be appreciated that the dust bag 20 according to the present invention may be periodically reused over a prolonged period of time until it is full of dust, with a full electrostatic charge thereon (and hence full magnetic filtration capabilities) as the charge is continually renewed each time that the bag is used. If desired, the vacuum cleaner 12 may be provided with an on/off switch 60 for enabling or disabling the electrostatic generator 42 so that the user has the option of employing or not employing the same.

Means are preferably provided for automatically grounding the entire electrostatically charged network (i.e., the bag 20, the leads 44, and even possibly the generator 42) whenever the interior of the vacuum cleaner 12 is accessed—e.g., for replacement of the dust bag 20—so as to protect the user from the high voltage (albeit low current) present in the system. For this reason, as well as others, the plug 32 is preferably grounded.

Those skilled in the electrostatic arts will appreciate that, regardless of the charge maintained on the bag 20, the charge will have little magnetic filtration effect unless the dust particles entering in the dirt-laden air are also charged. While, as aforenoted, typically the dirt-laden air contains a fraction of negatively charged small particles of dust, this will not necessarily be the case, for example, where the climate is quite humid. In order to overcome such a situation, and in any case to increase the proportion of negative charged small dust particles in the initially dirt-laden air, a preferred embodiment of the present invention additionally includes means for generating on the dust particles in the initially dirt-laden air an electrostatic charge of the same polarity as that on the bag (typically a negative electrostatic charge).

Figure 4:
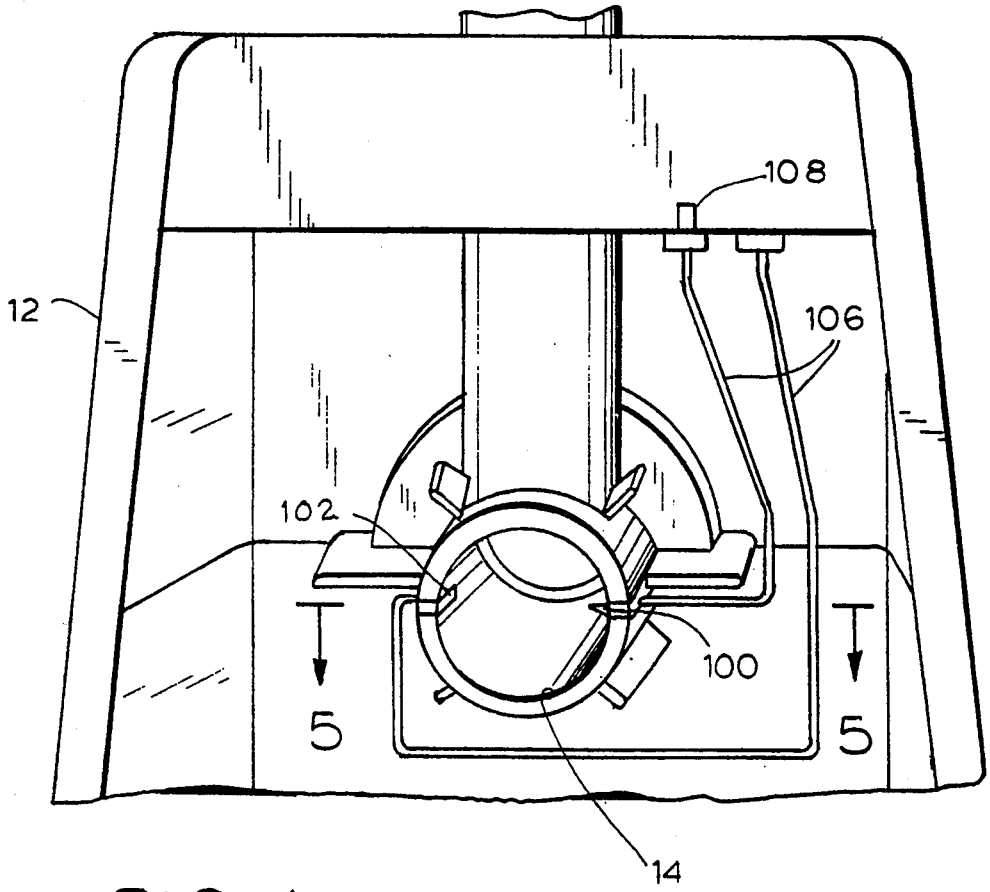
FIG. 4 is a fragmentary isometric view of another embodiment of the present invention, with the dust bag removed.
Figure 5:
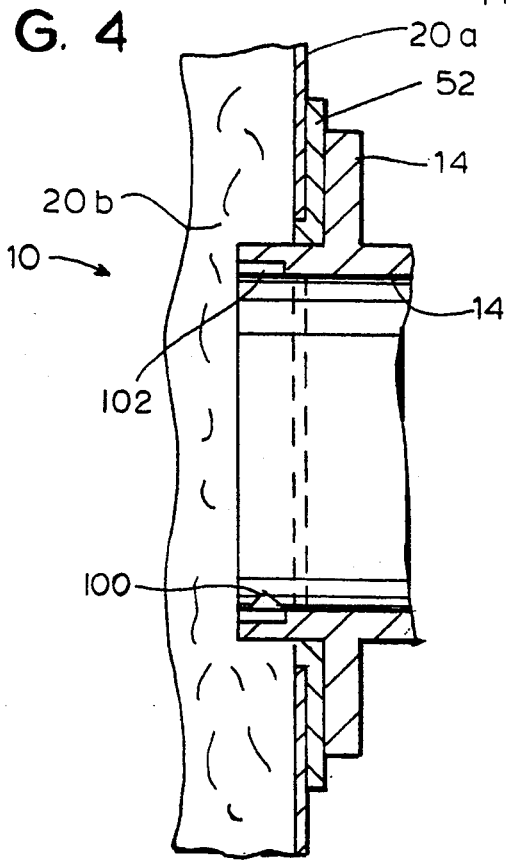
FIG. 5 is a sectional view taken along the line 5—5 of FIG. 4 with the bag in place.

Referring now to FIGS. 4 and 5, therein illustrated is a second embodiment 10' of the present invention. Reference numerals from the first embodiment 10 are used to identify like elements of the second embodiment 10'. Instead of the electrostatic charge generator 42 of the first embodiment 10, the second embodiment 10' utilizes a corona discharge apparatus comprising a cathode 100 defining an edge and an anode 102 defining a plate, both electrodes being disposed on the inner surface of inlet 14. These electrodes 100, 102 are disposed so as to face each other across the air inlet 14 and are subjected to a voltage differential through the wires 106 according to the setting of an on/off switch 108. The electrical differential between the electrodes 100, 102 results in electrons being torn away from the edge or point of the cathode 100 and drawn toward the facing plate or gently curved surface of the anode 102. As the area within the inlet 14 becomes electron-enriched, the small dust particles in the dirt-laden air passing there through (on their way into the interior of the bag 12 mounted on the outer surface of the inlet 14) and the dust bag 12 (and especially any inner ply **20*b*** thereof) become electron-enriched as well.

It will be appreciated that when the corona discharge system 100,102 of the second embodiment 10' is employed, the first generating means 40 for producing an electrostatic charge on the bag is unnecessary as the second—now sole—generating means (i.e., the corona discharge apparatus 100,102) necessarily generates an electrostatic charge of a given polarity in both the bag 20 and the initially dirt-laden air. Typically the need to enrich the swiftly moving dirt-laden air will determine the density of electrons optimally to be produced by the corona discharge apparatus. A corona discharge voltage of 1,000 to 15,000 volts is preferred, by way of example, for a typical air flow rate of 80 cubic feet per minute.

The first and second embodiments 10, 10' of the present invention may, however, be combined in a single vacuum cleaner so as to afford the user the option of either electrostatically charging the bag 20 by itself (using the first generating means 40) or electrostatically charging both the bag 20 and the dirt-laden air (using the second generating means 100, 102). An appropriately mounted switch (not shown) may allow the user to select either no charging, bag charging alone, or bag and air charging, as the user prefers.

To summarize, the present invention provides a vacuum cleaner system wherein the leakage of electrostatic charge from the dust bag does not adversely effect operation of the vacuum cleaner, so that the bag does not require protection from moisture at any time. The user of the system decides whether or not to employ an electrostatically charged dust bag. The system itself is capable of increasing the efficiency of the magnetic filtration characteristics of an electrostatically charged bag or imparting magnetic filtration characteristics to an uncharged bag. The present invention additionally provides dust bags suitable for use in such a system. The present invention permits the use of a vacuum cleaner with a comparable cleaning quality to be manufactured with a smaller and less powerful, but more efficient and more economical motor.

Now that the preferred embodiments of the present invention have been shown and described in detail, various modifications and improvements thereon will become readily apparent to those skilled in the art. Accordingly, the spirit and scope of the present invention is to be construed broadly and limited only by the appended claims, and not by the foregoing specification.

We claim:

1. A vacuum cleaner system comprising:

(A) a vacuum cleaner including:

(i) a hollow air inlet, (ii) an air outlet, (iii) a removeable dust bag communicating with said inlet and said outlet, said bag including an air-permeable non-woven filter inner ply and an air-permeable outer ply, and (iv) means for moving initially dirt-laden air from said inlet to said outlet via said bag, (B) first means for continuously generating in situ an electrostatic charge of a given polarity on said inner ply of said bag; and (C) second means for continuously generating an electrostatic charge of said given polarity on the initially dirt-laden air.

2. The system of claim 1 wherein said given polarity is negative.

3. The system of claim 1 wherein said first generating means is an electrostatic generator.

4. The system of claim 1 wherein said second generating means is means for producing a corona discharge.

5. The system of claim 1 wherein each of said first generating means and said bag defines an electrical contact, said electrical contacts being in electrical communication when said bag is disposed in said cleaner for use therein.

6. The system of claim 5 wherein said electrical contacts of said generating means and said bag are disposed in the exterior of said inlet and the interior of said bag, respectively.

7. The system of claim 1 wherein said first generating means also generates an electrostatic charge on the initially dirt-laden air passing through said inlet and is a corona discharge apparatus having its spaced apart electrical contacts disposed on the interior of said inlet.

8. The system of claim 7 wherein there is a single generating means capable of generating an electrostatic charge of said given polarity in both said bag and the initially dirt-laden air.

9. The system of claim 1 additionally including means for manually activating and deactivating each of said generating means.

* * * * *